US012588717B2

(12) United States Patent
Martiré

(10) Patent No.: US 12,588,717 B2
(45) Date of Patent: Mar. 31, 2026

(54) CLOTHING FOR CLEAN ROOM HAVING AN INTEGRATED POUCH, AND ASSOCIATED PACKAGING METHOD

(71) Applicant: ELIS SERVICES, Puteaux (FR)

(72) Inventor: Xavier Martiré, Puteaux (FR)

(73) Assignee: ELIS SERVICES, Puteaux (FR)

( * ) Notice: Subject to any disclaimer, the term of this patent is extended or adjusted under 35 U.S.C. 154(b) by 0 days.

(21) Appl. No.: 18/690,600

(22) PCT Filed: Sep. 6, 2022

(86) PCT No.: PCT/EP2022/074744
§ 371 (c)(1),
(2) Date: Mar. 8, 2024

(87) PCT Pub. No.: WO2023/036776
PCT Pub. Date: Mar. 16, 2023

(65) Prior Publication Data

US 2024/0373953 A1 Nov. 14, 2024

(30) Foreign Application Priority Data

Sep. 10, 2021 (FR) ..... 2109531

(51) Int. Cl.
*A41D 13/00* (2006.01)
*A41D 15/04* (2006.01)

(52) U.S. Cl.
CPC ..... *A41D 13/0002* (2013.01); *A41D 15/04* (2013.01); *A41D 2400/42* (2013.01)

(58) Field of Classification Search
CPC ..... A41D 13/0002; A41D 13/1209; A41D 13/02; A41D 13/1218; A41D 13/129;
(Continued)

(56) References Cited

U.S. PATENT DOCUMENTS 4,475,251 A * 10/1984 Hopkins ..... A45C 9/00 2/85
5,165,111 A * 11/1992 Lieberman ..... A45F 3/04 2/108

(Continued)

FOREIGN PATENT DOCUMENTS

CN 202286422 U * 7/2012 ..... A41D 15/04
EP 3581045 A1 * 12/2019 ..... A41D 13/02

(Continued)

OTHER PUBLICATIONS

PCT/EP2022/074744, "International Search Report and Written Opinion" w/ English translations attached, Nov. 24, 2022, 16 pages.

*Primary Examiner* — Aiying Zhao
(74) *Attorney, Agent, or Firm* — Kilpatrick Townsend & Stockton LLP

(57) ABSTRACT

Piece of protective clothing for a cleanroom intended to be worn by a user and comprising an outer face provided to be in contact with the outside environment and an inner face arranged to be in contact with the user wearing said piece of clothing, the piece of clothing comprising a pouch for packaging the piece of clothing and connected to the inner face of the piece of clothing by irreversible fastening means and having a single wall connected by its contours to the inner face of the piece of clothing and having an outer face provided to be in contact with the outside environment once the piece of clothing has been packaged in the pouch and an inner face provided to be in contact with the user wearing said piece of clothing, the wall having four corners and an opening having a rounded shape extending between two opposite corners.

6 Claims, 9 Drawing Sheets

(58) Field of Classification Search
CPC ..... A41D 1/06; A41D 15/00; A41D 15/04; A41D 2400/42
See application file for complete search history.

(56) References Cited

U.S. PATENT DOCUMENTS

| | | | | | |
|---|---|---|---|---|---|
| 5,787,504 | A * | 8/1998 | Wu | B65D 33/00 | 2/93 |
| 6,370,692 | B1 * | 4/2002 | Duyn | A41D 3/02 | 2/202 |
| 7,395,555 | B2 * | 7/2008 | Aldridge | A41D 31/065 | 2/93 |
| 8,056,146 | B2 * | 11/2011 | Porowski | A41D 13/1209 | 2/901 |
| 2009/0084695 | A1 * | 4/2009 | Vellutato, Jr. | B65D 85/18 | 53/425 |
| 2019/0269184 | A1 * | 9/2019 | Gracie | A41D 15/04 | |

FOREIGN PATENT DOCUMENTS

| | | | | |
|---|---|---|---|---|
| JP | 2020143419 | A * | 9/2020 | A41D 1/04 |
| WO | 2009036021 | A1 | 3/2009 | |
| WO | WO-2021099631 | A1 * | 5/2021 | A41D 13/02 |

* cited by examiner

CLOTHING FOR CLEAN ROOM HAVING AN INTEGRATED POUCH, AND ASSOCIATED PACKAGING METHOD

CROSS-REFERENCE TO RELATED APPLICATIONS

This application is a national stage of PCT Application No. PCT/EP2022/074744, filed on Sep. 6, 2022, and entitled "Clothing For Clean Room Having an Integrated Pouch, and Associated Packaging Method", which claims the benefit of French Patent Application No. FR2109531, filed on Sep. 10, 2021 and entitled "Clothing For Clean Room Having an Integrated Pouch, and Associated Packaging Method", the entirety of each of which is hereby incorporated by reference herein.

BACKGROUND OF THE INVENTION

The present invention relates to the field of protective clothing for cleanrooms.

"Cleanrooms" means rooms with a controlled atmosphere, aseptic and sterile.

Cleanrooms are in particular used in numerous fields such as electronics, micromechanics, optics, nano and biotechnologies, pharmaceutics, sterile preparations in pharmacy, medical equipment or in the agri-food industry.

In this type of room, it is necessary to isolate the body of the staff working inside said rooms in order to minimise the dispersion of microorganisms and the particles that they generate themselves, and thus avoid any contamination of the cleanroom.

It is thus known to equip the staff intended to work in cleanrooms with protective clothing, in particular suits.

Such protective clothing is sterile and provided in sealed packaging. The user must put on the piece of protective clothing without touching the outer face intended to be in contact with the sterile environment of the cleanroom.

Reference can be made to document FR2809933 which describes a suit for cleanrooms intended to be put on by gripping it by the inside and thus avoiding any contamination external to the cleanroom.

Generally, the protective clothing is contained in a sterilised and individual but disposable packaging, in other words single use: this represents a considerable source of waste.

However, such disposable packaging constitutes a significant quantity of inorganic waste. The current trend is to reduce single-use packaging and the associated waste.

Reference can be made to WO 2021/099631 which proposes a piece of protective equipment for a cleanroom packaged in a reusable and sterilisable pouch.

However, the opening of such a pouch does not allow to take out or to repackage the piece of clothing easily.

Thus, there is a need to improve the protective clothing for cleanrooms with the goal of reducing their environmental and ecological impact, without having a negative effect on the sterility of the piece of clothing, and while simplifying the extraction and the repackaging of the piece of clothing.

Another goal is to limit the costs associated with the logistics of the piece of protective clothing in terms of decontamination, repackaging and storage.

BRIEF DESCRIPTION OF THE INVENTION

The object of the invention is a piece of protective clothing for a cleanroom intended to be worn by a user and comprising an outer face provided to be in contact with the outside environment and an inner face arranged to be in contact with the user wearing said piece of clothing.

The piece of clothing comprises a reusable and sterilisable pouch for packaging the piece of clothing connected to the inner face of the piece of clothing by irreversible fastening means, such as sewing or welding.

The packaging pouch comprises a single wall connected by its contours to the inner face of the piece of clothing and comprising an outer face provided to be in contact with the outside environment once the piece of clothing has been packaged in the pouch and an inner face provided to be in contact with the user wearing said piece of clothing, the wall being defined by four corners and comprising an opening having a rounded shape extending between two diagonally opposite corners.

The rounded opening allows to facilitate the extraction of the piece of clothing from said pouch, as well as its repackaging.

In other words, the pouch is formed from a single wall defined by four corners forming a contour.

Said contour is connected to the inner face of the piece of clothing and defines a zone of the inner face of the piece of clothing facing the outer face of the wall.

The combination of said wall and the zone of the inner face of the piece of clothing facing the wall forms the pouch in which the piece of clothing is put away.

In the packaging position of the piece of clothing in the pouch, the outer face of the wall and the zone of the inner face of the piece of clothing are in contact with the outside environment.

In the configuration of use of the piece of clothing by the user, the outer face of the pouch faces the inner face of the piece of clothing.

The opening forms, preferably, a half-circle.

Thus, in the folded and packaged position, the inner face of the piece of clothing is connected to the inner face of the pouch so that only the outer face of the pouch is in contact with the outside environment.

Advantageously, the opening of the wall of the packaging pouch is closed by a zip fastener.

For example, the packaging pouch comprises a flap intended to cover the opening, in particular the zip fastener, in the packaged position of the piece of clothing in the packaging pouch.

The flap can, for example, be connected to the wall partly along two sides and mobile between a free position of the opening, in particular of the zip fastener, and a position covering said opening, in particular of the zip fastener.

For example, the flap is provided, at each opposite corner, with an opening in order to avoid the accumulation of particles at the zip fastener.

The flap is, advantageously, made of textile material.

The storage pouch is, advantageously, made of textile material.

According to one embodiment, the piece of protective clothing is a suit comprising a first and a second leg sections, a first sleeve, a second sleeve and a body part, the first sleeve, the second sleeve, the two leg sections each being connected to the body part to form a suit.

Advantageously, the wall of the packaging pouch is rigidly connected onto the inner face of the body part.

Alternatively, the piece of protective clothing could be trousers, a top, a balaclava, or any other type of protective clothing.

For example, the body part comprises a head passage section and an opening closed by closing means, for example a zip fastener.

According to another aspect the invention relates to a method for packaging a piece of protective clothing for a cleanroom in a packaging pouch, said piece of clothing being intended to be worn by a user and comprising an outer face provided to be in contact with the outside environment and an inner face arranged to be in contact with the user wearing said piece of clothing.

Said pouch for packaging the piece of clothing is connected to the inner face of the piece of clothing by irreversible fastening means, such as sewing or welding, and comprises a single wall connected by its contours to the inner face of the piece of clothing and comprising an outer face provided to be in contact with the outside environment once the piece of clothing has been packaged in the pouch and an inner face provided to be in contact with the user wearing said piece of clothing, the wall being defined by four corners and comprising an opening having a rounded shape extending between two opposite corners.

According to the packaging method:

- the piece of clothing is folded so as to leave visible the inner face of the wall of the pouch; and
- the piece of clothing is gripped by the inside of the pouch and the piece of clothing is pulled on through the opening until the piece of clothing ends up inside said pouch.

Advantageously, once the piece of clothing has been placed inside the packaging pouch, the opening is closed by actuating a zip fastener and a flap provided on said pouch is then folded over until it covers the zip fastener.

BRIEF DESCRIPTION OF THE DRAWINGS

The present invention will be better understood upon studying the detailed description of embodiments, taken as examples that are in no way limiting and illustrated by the appended drawings, in which.

DETAILED DESCRIPTION OF THE INVENTION

In the rest of the description, the expressions "outer" and "inner" refer to the use of the piece of clothing by a user, an inner surface being closer to the user than an outer surface under conditions of normal use of the piece of clothing.

Figure 1:
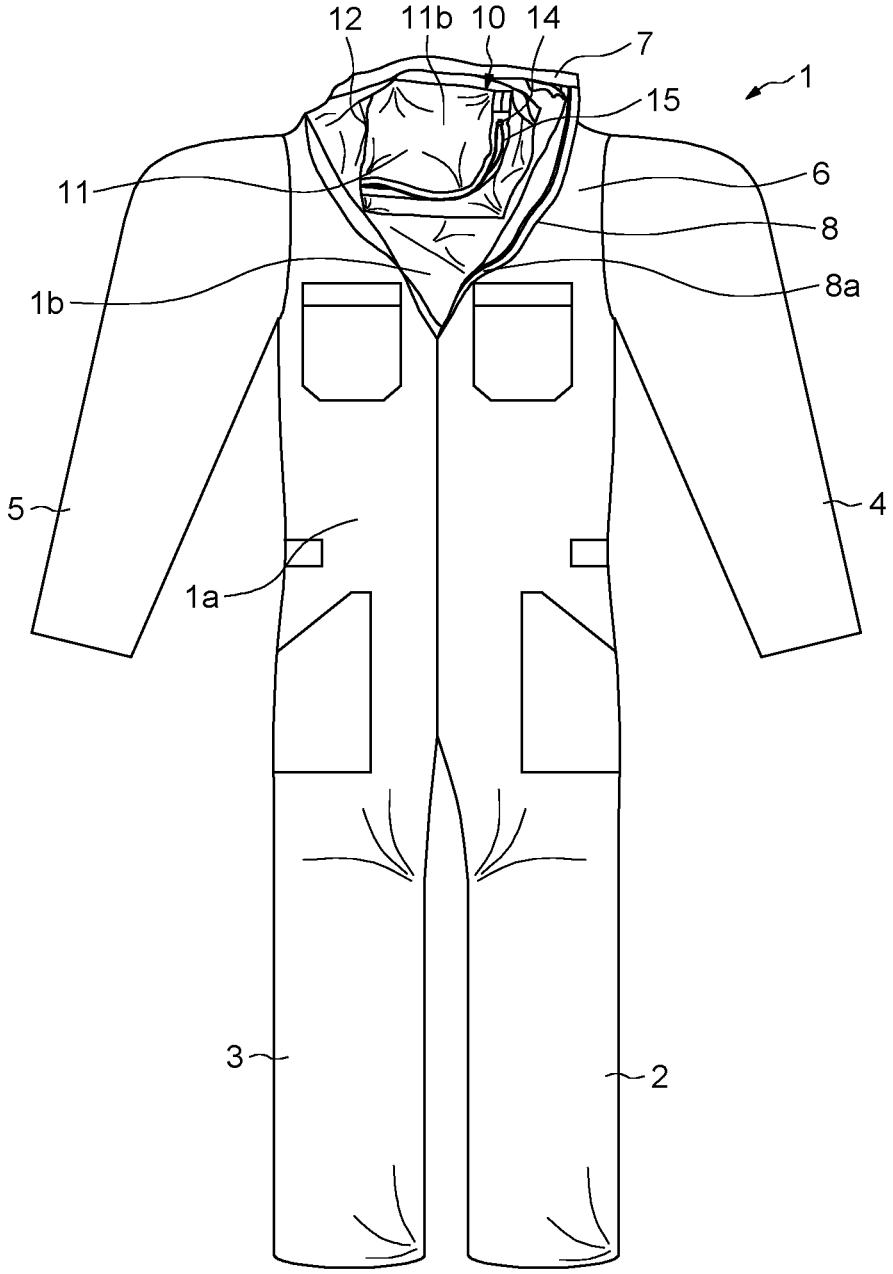
FIG. 1 is a front view of the piece of clothing according to an embodiment of the invention, in which the piece of clothing is a suit.

A piece of protective clothing 1 for a cleanroom or asepticised environment is illustrated in FIG. 1.

The piece of protective clothing 1 is, here, a suit comprising a first and a second leg sections 2, 3.

Figure 5:
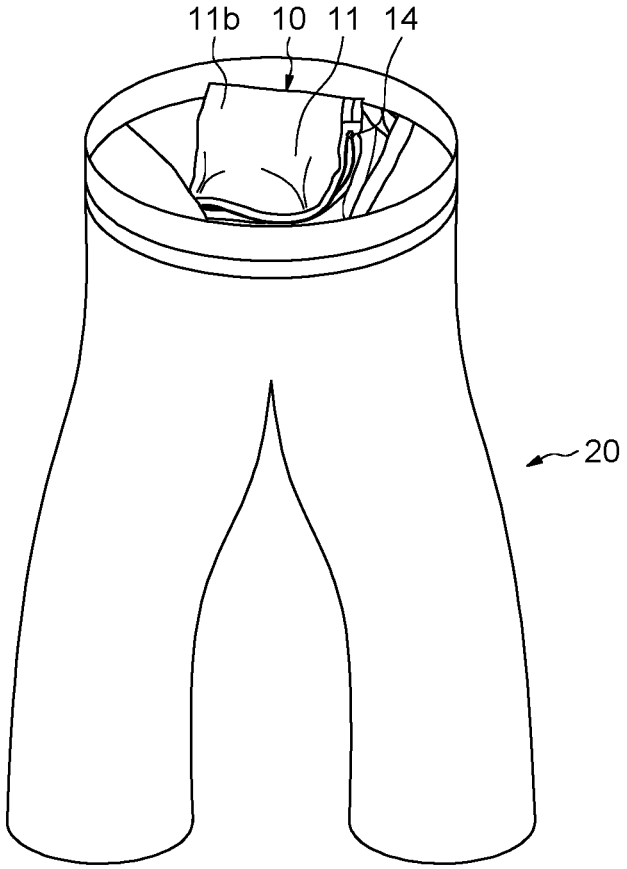
FIG. 5 is a front view of the piece of protective clothing according to an embodiment of the invention, in which the piece of clothing is a pair of trousers.

Alternatively, the piece of protective clothing could be a pair of trousers 20 as illustrated in FIG. 5 in which the same elements carry the same references. The piece of protective clothing could also be a top, a balaclava, or any other type of piece of protective clothing.

The leg sections 2, 3 can, in a manner that is in no way limiting, be provided with closing means (not shown).

The piece of protective clothing 1 also comprises a first sleeve 4, a second sleeve 5 and a body part 6. The first sleeve 4, the second sleeve 5, the two leg sections 2, 3 are each connected to the body part 6 to form a suit.

The body part 6 comprises a head passage section 7 and an opening 8 closed by closing means, for example a zip fastener.

The suit 1 comprises an outer face 1*a* provided to be in contact with the outside environment and an inner face 1*b* arranged to be in contact with the user wearing said suit.

The suit 1 comprises a packaging pouch 10 comprising a single wall 11 connected by its contours to the inner face 1*b* of the suit by irreversible fastening means 12, such as welding or sewing.

Figure 2:
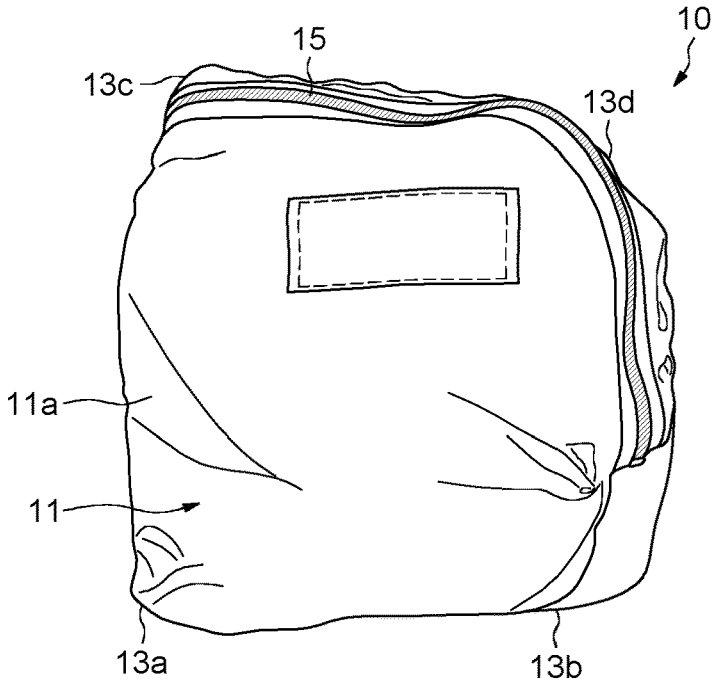
FIGS. 2-3 are front views of the packaging pouch of the piece of clothing of FIG. 1, in a configuration in which the piece of clothing is packaged in said pouch.
Figure 3:
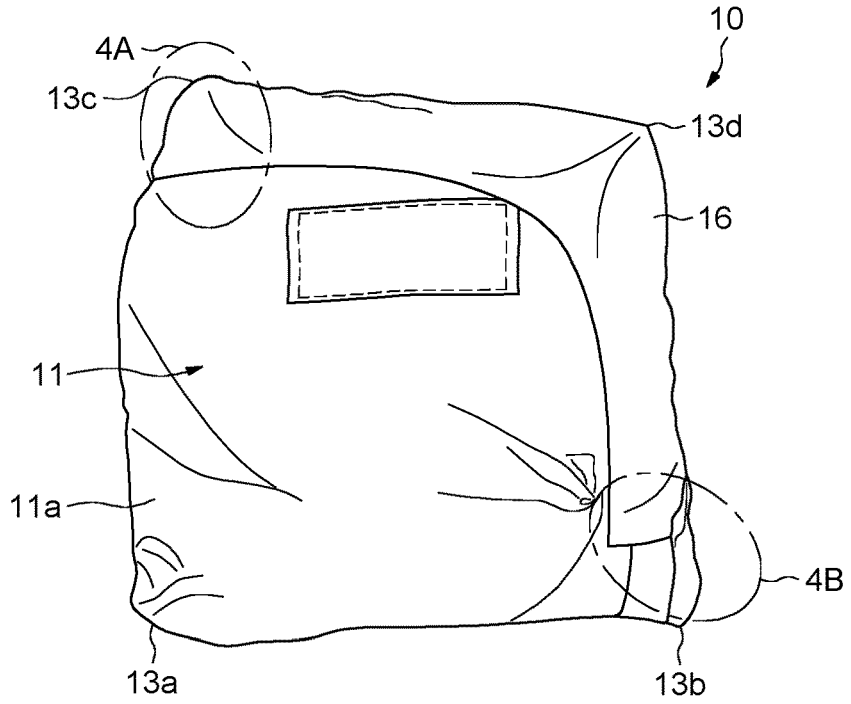
Figure 4A:
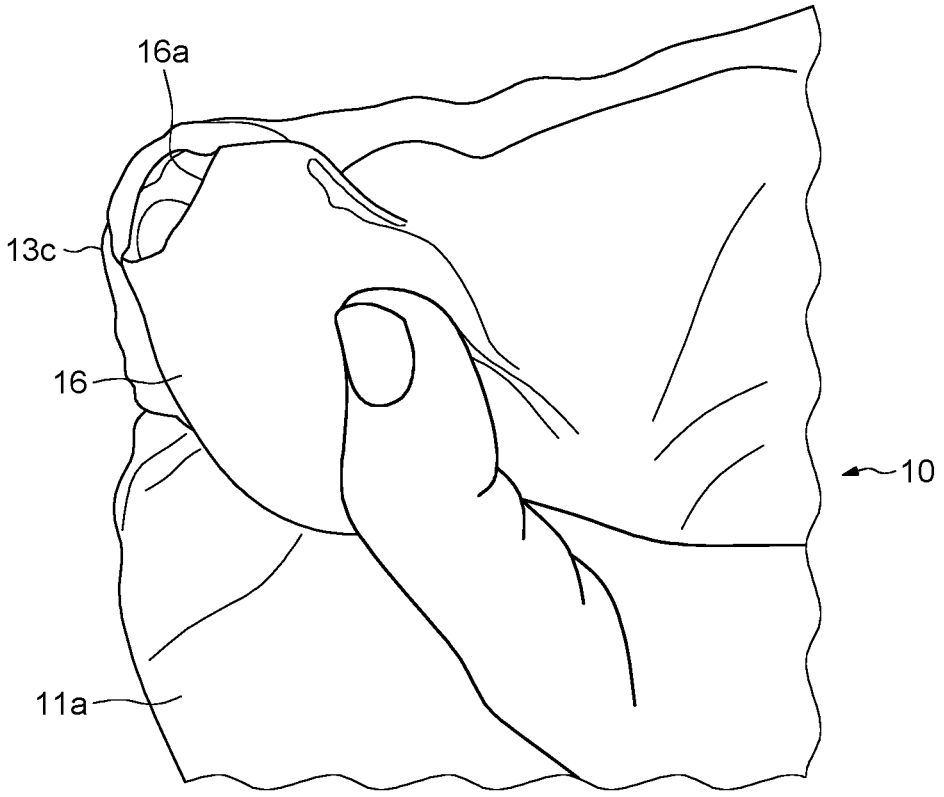
FIGS. 4A-4B are views of details of FIG. 3.
Figure 4B:
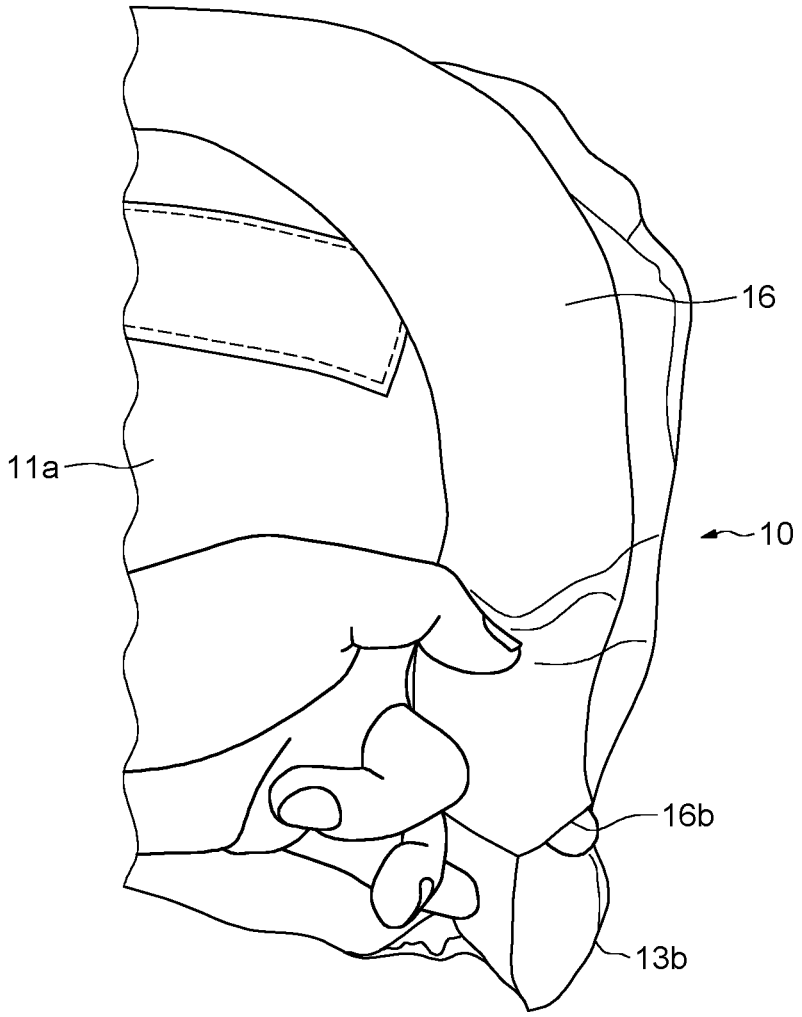

The wall 11 of the packaging pouch 10 comprises an outer face 11*a* visible in FIGS. 2 and 3 provided to be in contact with the outside environment once the piece of clothing has been packaged in the pouch 10.

The wall 11 of the packaging pouch 10 comprises an inner face 11*b* provided to be in contact with the user wearing said suit.

In the configuration of use of the suit by the user, the inner face 11*b* of the pouch 10 faces the inner face 1*b* of the body part 6 of the suit 1.

Thus, in the folded and packaged position, the inner face 1*b* of the suit 1 is connected to the inner face of the wall in such a way that only the outer face of the pouch is in contact with the outside environment, as illustrated in FIGS. 2 and 3.

The wall 11 of the packaging pouch 10 has, here, a parallelepipedic shape comprising four corners 13*a*, 13*b*, 13*c*, 13*d*.

The wall 11 of the packaging pouch 10 further comprises an opening 14 extending between two diagonally opposite corners 13*c*, 13*b*, as visible in FIG. 2.

The opening 14 has, here, a rounded shape in order to facilitate the extraction of the piece of clothing from said pouch, as well as its repackaging.

The opening forms, here, a half-circle.

The opening 14 comprises a zip fastener 15 intended to close said opening 14.

In a manner that is in no way limiting, the wall 11 of the packaging pouch 10 also comprises a flap 16 intended to cover the zip fastener 15 in the packaged position of the piece of clothing 1 in the packaging pouch 10.

Alternatively, the packaging pouch could not have a flap.

The flap 16 is connected to the wall 11 partly along two sides in order to be able to switch from a free position of the zip fastener 15, visible in FIG. 2, towards a covered position of said zip fastener 15, visible in FIG. 3.

The flap 16 is made of textile material.

The flap 16 allows to reduce the entry of the particles by the zip fastener 15 which is thus covered by a protection.

The flap 16 is provided, at each opposite corner, with an opening 16*a*, 16*b* in order to avoid the accumulation of particles at the zip fastener 15.

The repackaging of the piece of clothing 1 inside the pouch 10 is carried out as follows, in reference to FIGS. 6A to 6G.

Figure 6A:
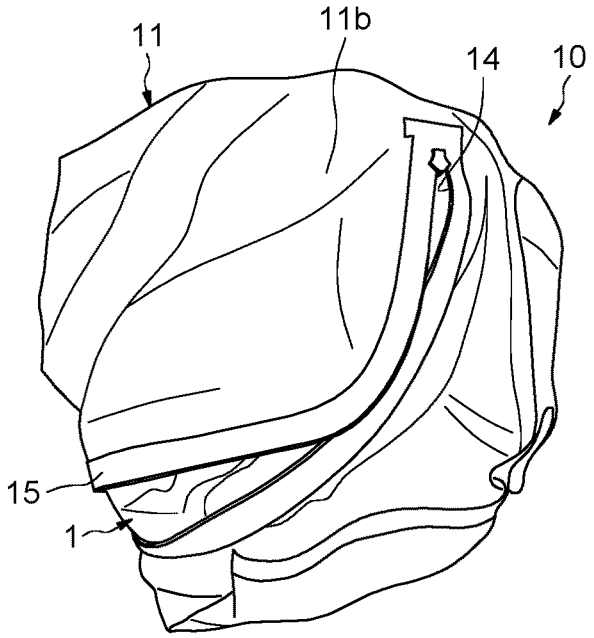
FIGS. 6A-6G illustrate the steps of the method for packaging the piece of protective clothing in the packaging pouch of FIG. 1.

During the first step of the method for repackaging the piece of clothing, the user folds the suit 1 so as to leave visible the inner face 11*b* of the pouch 10, as illustrated in FIG. 6A.

Figure 6B:
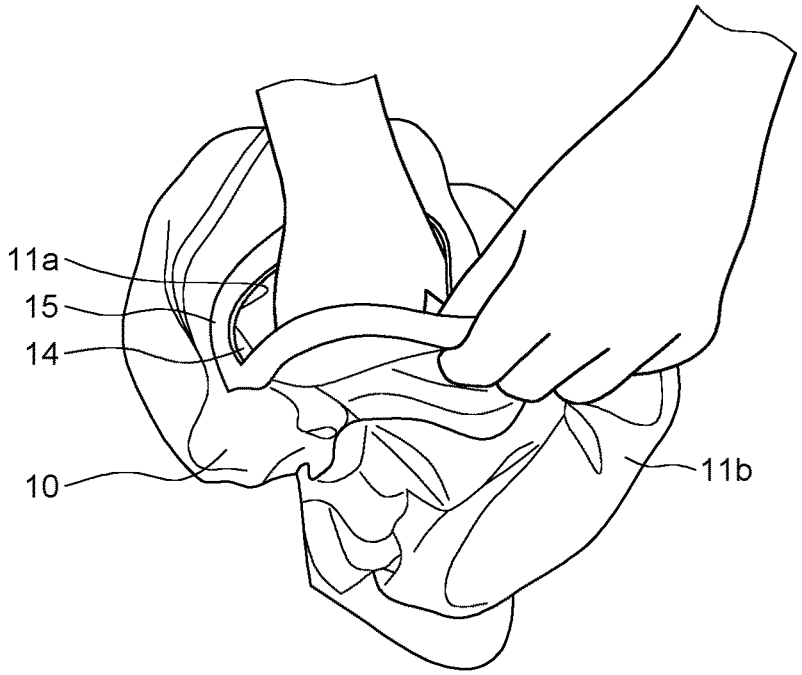
Figure 6C:
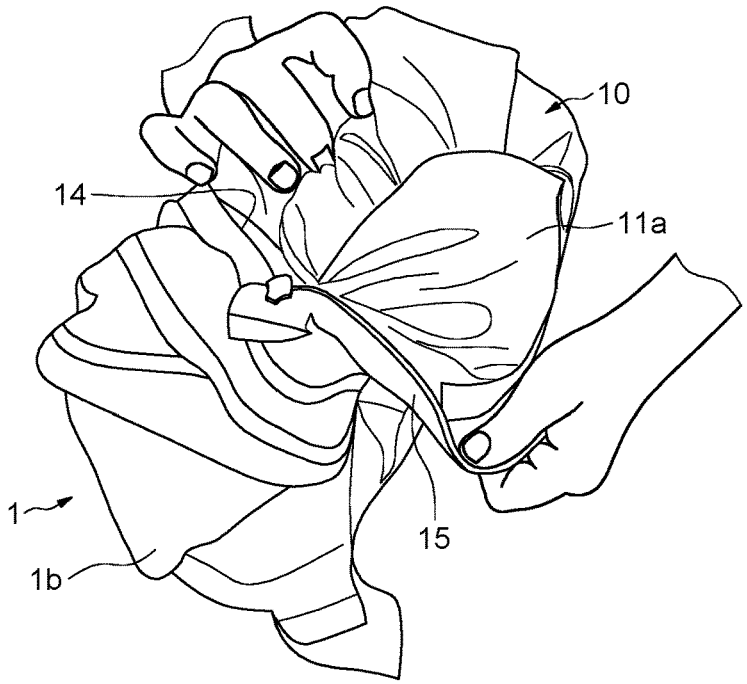
Figure 6D:
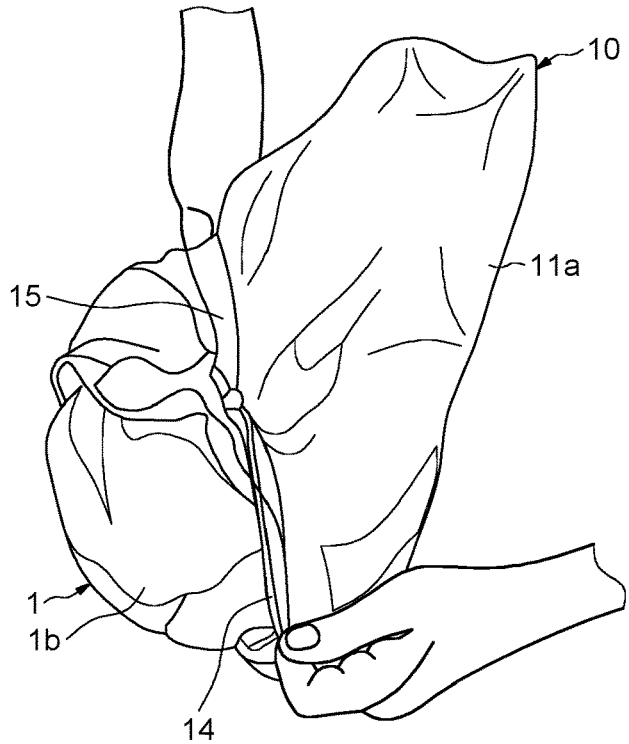

Once the suit has been folded, the user grips the suit 1, in particular its inner surface 1*b*, by the inside of the pouch 10, as visible in FIG. 6B and pulls on the suit 1 through the opening 14 until the suit 1 ends up inside the pouch 1 as visible in FIGS. 6C and 6D.

Figure 6E:
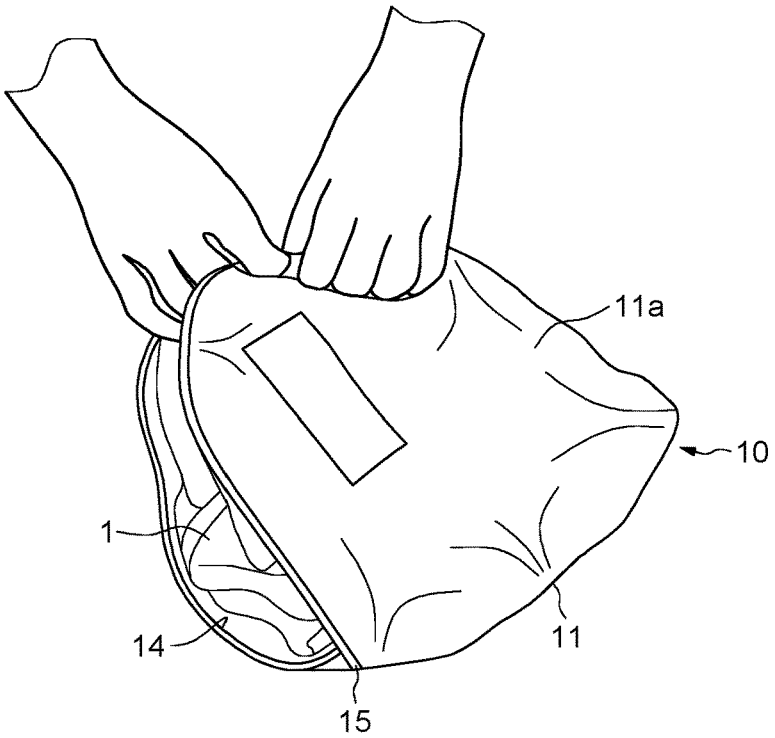
Figure 6F:
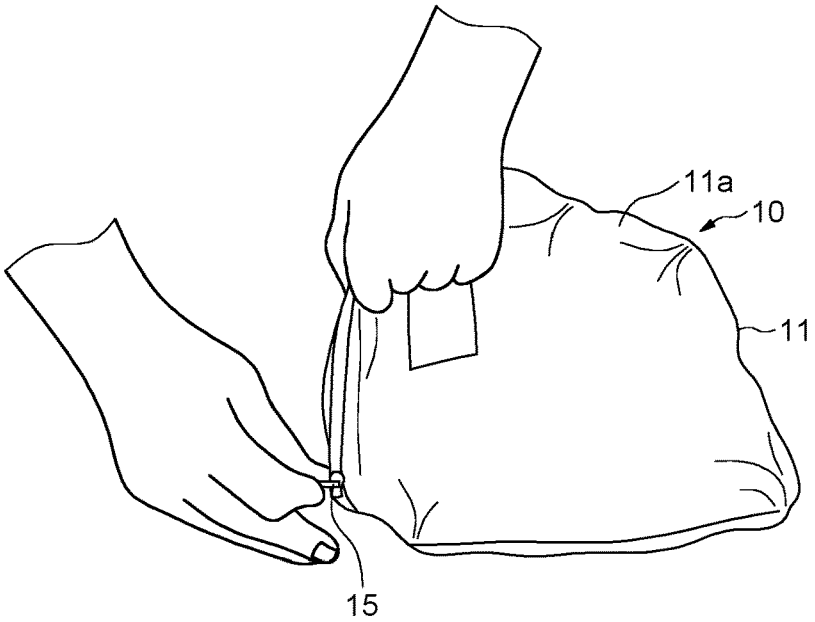

Once the suit 1 has been placed inside the pouch 10, as visible in FIG. 6E, the user closes the opening 14 by actuating the zip fastener 15, as visible in FIG. 6F.

Figure 6G:
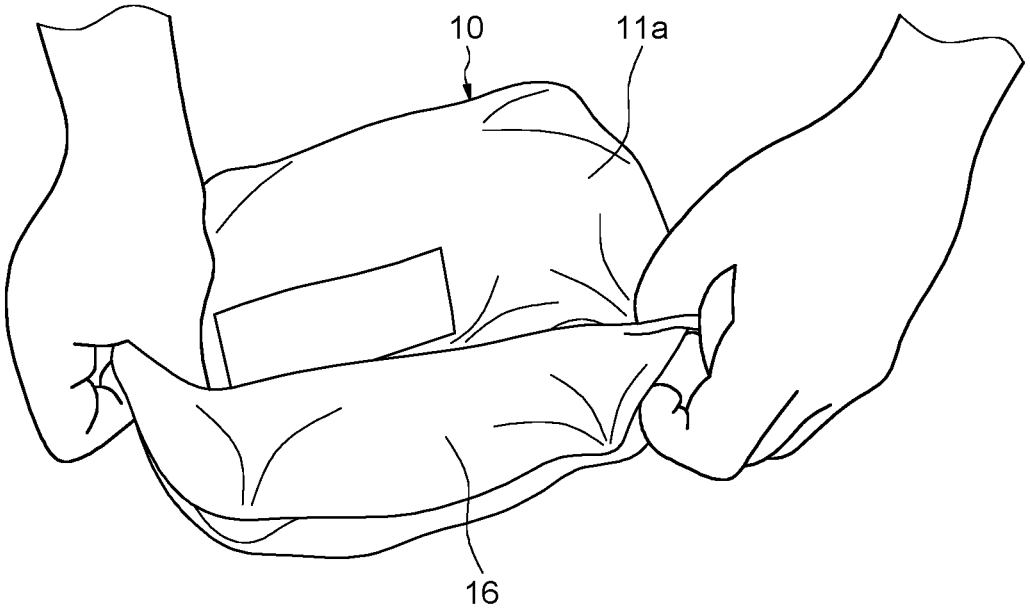

The user then folds over the flap 16 and in particular until it covers the zip fastener 15, as visible in FIG. 6G.

The suit 1 thus packaged in the pouch 10 can be sterilised, for example, in an autoclave.

When the user puts on the suit 1 again, they open the means 15 for closing the opening 14 of the pouch 1, remove the suit 1 from the pouch by pulling on it by its inner face 1*b*.

Via the invention, a piece of protective clothing for a cleanroom that is easy to package and to unfold is obtained, while reducing the environmental and ecological impact, without having a negative effect on the sterility of the environment.

The invention claimed is:

1. A piece of protective clothing for a cleanroom intended to be worn by a user, the piece of clothing comprising:

an outer face provided to be in contact with an outside environment;

an inner face arranged to be in contact with the user wearing said piece of clothing;

a single wall defined by four corners forming a contour, an outer face facing the inner face of the piece of clothing, and an inner face provided to be in contact with the user wearing said piece of clothing, the single wall comprising an opening delimited by opposite edges extending between two diagonally opposite corners of the four corners of the single wall, wherein:

the contour of the single wall is connected to the inner face of the piece of clothing by irreversible fastening means;

the contour of the single wall defines a zone of the inner face of the piece of clothing facing the outer face of the single wall;

the single wall and said zone of the inner face of the piece of clothing form or define a pouch for packaging the piece of clothing;

the outer face of the single wall and said zone of the inner face of the piece of clothing are in contact with the outside environment when the piece of clothing is positioned in the pouch;

the opening of the single wall of the pouch is closed by a zip fastener;

the pouch comprises a flap intended to cover the opening in the packaged position of the piece of clothing in the pouch;

the flap includes opposing corners or ends;

the flap is connected to the single wall partly along two sides and is movable between a free position of the opening towards a position covering said opening; and the flap includes an opening at each opposing corner or end.

2. The piece of clothing according to claim 1, wherein the flap is made of textile material.

3. The piece of clothing according to claim 1, wherein the single wall of the pouch is made of textile material.

4. The piece of clothing according to claim 1, wherein the piece of protective clothing is a suit comprising a first and a second leg sections, a first sleeve, a second sleeve and a body part, the first sleeve, the second sleeve, the first and second leg sections each being connected to the body part to form the suit.

5. The piece of clothing according to claim 4, wherein the single wall of the pouch is connected onto the inner face of the body part.

6. A piece of protective clothing for a cleanroom intended to be worn by a user, the piece of clothing comprising:

an outer face provided to be in contact with an outside environment;

an inner face arranged to be in contact with the user wearing said piece of clothing; and a single wall having a peripheral contour and comprising:

an outer face facing the inner face of the piece of clothing; and an inner face provided to be in contact with the user wearing said piece of clothing, wherein:

the contour of the single wall is secured to a zone of the inner face of the piece of clothing;

the outer face of the single wall and said zone of the inner face of the piece of clothing form a pouch for packaging the piece of clothing;

the outer face of the single wall and said zone of the inner face of the piece of clothing are in contact with the outside environment when the piece of clothing is packaged in the pouch;

the single wall comprises an opening closed by a zip fastener and the pouch comprises a flap having opposite corners, the flap being configured to cover the zip fastener when the piece of clothing is packaged in the pouch; and each opposite corner of the flap comprises an opening in order to avoid an accumulation of particles at the zip fastener.

* * * * *